US006640753B2

(12) United States Patent
Villarroel

(10) Patent No.: US 6,640,753 B2
(45) Date of Patent: Nov. 4, 2003

(54) STEAM GENERATOR OF A WATER-TUBE TYPE

(76) Inventor: Danilo Villarroel, Ar. Tobalaba 3696, Santiago (CL)

( * ) Notice: Subject to any disclaimer, the term of this patent is extended or adjusted under 35 U.S.C. 154(b) by 0 days.

(21) Appl. No.: 10/013,674

(22) Filed: Dec. 13, 2001

(65) Prior Publication Data

US 2002/0079096 A1 Jun. 27, 2002

(30) Foreign Application Priority Data

Dec. 22, 2000 (CL) ..... 3589 2000

(51) Int. Cl.[7] ..... F22B 37/00

(52) U.S. Cl. ..... 122/6 A; 122/4 R; 122/18.1; 122/18.2

(58) Field of Search ..... 122/4 R, 6 A, 122/18.1, 18.2; 165/179

(56) References Cited

U.S. PATENT DOCUMENTS 4,479,359 A * 10/1984 Pelloux-Gervais ..... 165/133
6,209,225 B1 * 4/2001 Villarroel et al. ..... 34/599

* cited by examiner

*Primary Examiner*—Jiping Lu

(57) ABSTRACT

A steam generator of water-tubes type for burn fossil fuel where instead of the convective heat transfer of the present day boilers, the water-tubes are heated by means of the mechanism of heat conduction in solids. The water-tubes are embedded in a large piece of a metal or alloy of high thermal conductivity, to which the thermal energy of the combustion gas is transferred from a long horizontal tunnel. Besides, in contradistinction with the present boilers, the water-tubes are straight and of high thermal conductivity.

2 Claims, 2 Drawing Sheets

STEAM GENERATOR OF A WATER-TUBE TYPE

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

In the present steam generators that burn fossil fuel the hot gases of the combustion impinge directly against the outer surface of the tubes. This feature originates several troubles associated mainly with corrosion and buildup of deposits over the tubes. In fact, the deposits are very difficult to remove and affect the heat transfer process. Also, they are very corrosive, reason for which the tube wall needs to have an additional thickness in order to counterbalance the loss of metal. This in turn diminishes the flow of heat from the hot gases to the water and the steam. The corrosion due to the gases of the combustion is controlled using tubes of stainless steel, material that has a poor thermal conductivity, which difficults the flow of heat to the water and the steam. But, perhaps, the most serious restriction caused by the corrosive nature of the gases of combustion is related to the temperature of the steam, which has to be limited to five hundreds Celsius degree approximately in order to diminish the corrosive effects on the tubes. On the other hand, the overall efficiency of the process of transforming the thermal energy into mechanical energy is improved as the temperature of the steam increases.

The above mentioned troubles of the present day boilers become even more critical in coal-fired boilers, since coal produces a massive, sticky and very corrosive ash. This aspect is of special relevance because coal will play the role of the main fuel for the electric utility plants in the near future. The state of the art about steam generators can be found in the comprehensive book of the Babcock and Wilcox Company: STEAM, 40th edition.

BRIEF SUMMARY OF THE INVENTION

Instead of putting the water-tubes directly in contact with the gases of combustion, in the present innovation the water-tubes are embedded into a long horizontal block of metal or alloy of high thermal conductivity, called the heat distributor. Thus, in contrast with the present time boilers, the outer surface of the tubes are heated by means of the mechanism of thermal conduction in solids. The combustion gas is made to flow along a long horizontal tunnel, where the heat distributor rests over the top and along the tunnel. The thermal energy of the combustion gases is transferred to the heat distributor by means of a great number of heat transfer bars, which are embedded in the heat distributor and hang along the tunnel of gases.

The troubles associated with the formation of deposits almost disappear here, since the heat transfer bars have an aerodynamic profile, which resembles that of a dagger. In particular, the flow of hot gases is practically parallel to the surface of the heat transfer bars, which makes very difficult the growing of deposits. Also, because of this profile, the deposits tend to landslide and are easily removed.

In this invention the outer surface of the tubes is not exposed to corrosion; which allows to replace the traditional tubes of stainless steel of poor thermal conductivity by composite-tubes of high thermal conductivity. Moreover, since the corrosion problems are not as critical as in the present time boilers, the temperature of the steam can reach higher values than the currently in use.

BRIEF DESCRIPTION OF THE SEVERAL VIEWS OF THE DRAWING

The FIG. 1 shows a fragmental cross section of the steam generator, obtained by a cut with a plane orthogonal to the water-tubes.

The FIG. 2 shows a fragmental longitudinal view of the steam generator. The combustion gas is made to flow along the horizontal tunnel 6, from the left hand side to the right hand side of the figure. The burners are located at the beginning of the tunnel on the left hand side of the figure, while the exhaust exit of the combustion gas is located at the end of the tunnel, on the right hand side of the figure.

DETAILED DESCRIPTION OF THE INVENTION

Figure 1:
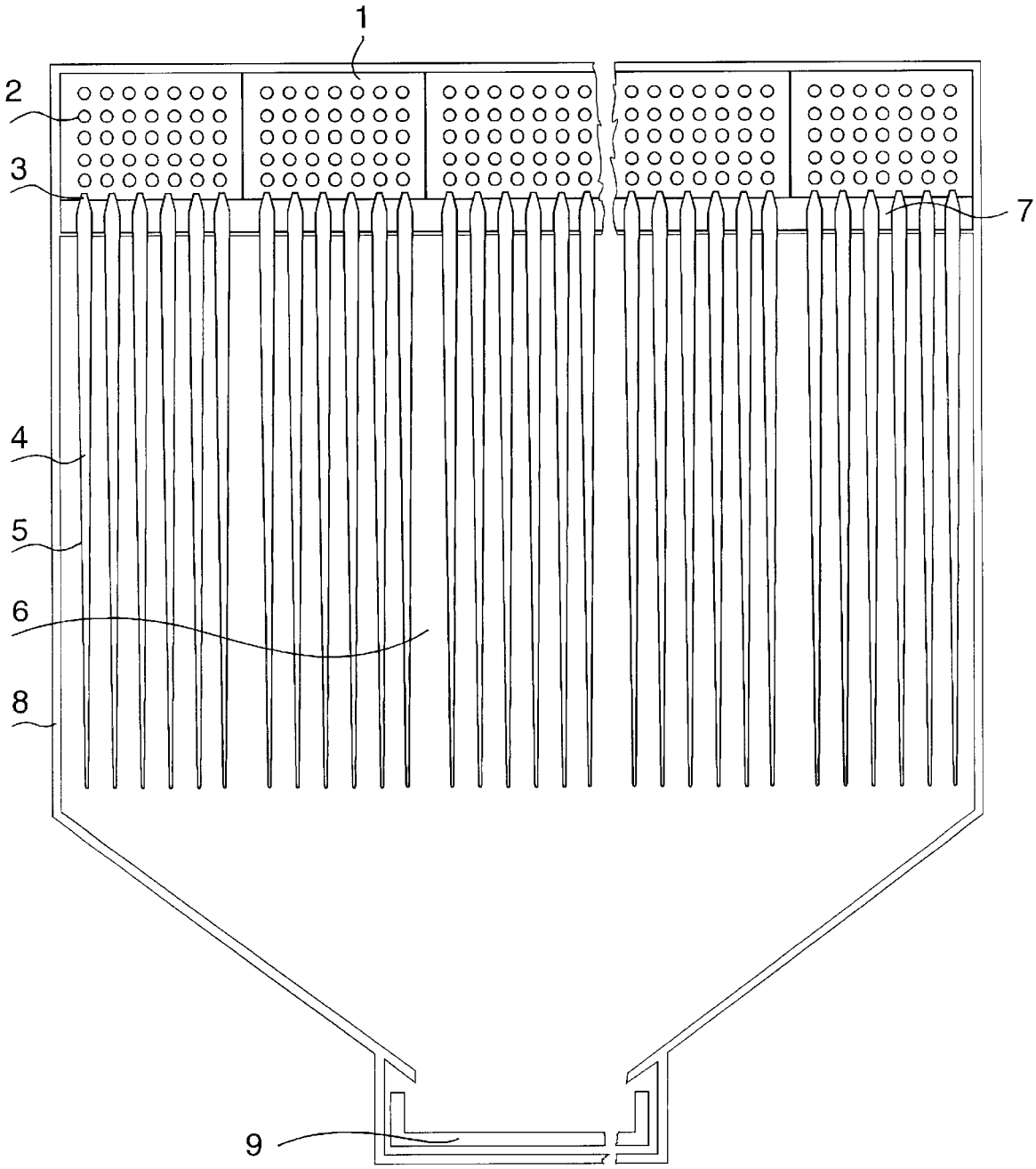

Referring to the FIG. 1, the key component of the steam generator of this invention is the heat distributor 1, which has a large length in the direction orthogonal to the plane of the figure. The heat distributor 1, which has the shape of an oblong parallelepiped with rectangular faces, is made with a metal or material of high thermal conductivity, and the water-tubes 2 are embedded and in intimate physical and thermal contact with it. The combustion gas is made to flow along the horizontal tunnel of large length 6, in a direction contrary to that of the water and the steam. The thermal energy of the fuel gases is transferred to the heat distributor 1 by means of a large number of heat transfer bars 4, made with the same material of high thermal conductivity as the heat distributor 1. In order to obtain an intimate contact with the heat distributor 1, the root 3 of the heat transfer bars 4 is embedded and fixed in the corresponding cavity that exists in the lower surface of 1.

The heat transfer bar 4 hangs, in vertical position, from the heat distributor 1 along the tunnel 6. The heat transfer bars have a profile that resembles the one of a dagger. In more precise words: when the heat transfer bars 4 are cut by a plane parallel to the lower plane surface of 1, the cross section obtained is similar to an ellipse, with its main axis much larger than the minor one; and where the length of both axes decrease as the distance to the heat distributor 1 increases. Therefore, since the main axis is parallel to the stream of the combustion gas, the heat transfer bars present an aerodynamic profile, in contradistinction with the case when the water-tubes are exposed to the stream of the combustion gas. This profile makes difficult the buildup of deposits and, at the same time, facilitates its removal. The cross section of the root 3 obtained by a plane parallel to the lower surface plane of the heat distributor 1 is also oval-shaped, with the length of both axes decreasing as the distance to the lower plane of 1 increases. The protection of the heat transfer bar 4 against corrosion and erosion is obtained by means of the sheath 5 of stainless steel, or a similar material, in which the heat transfer bar 4 is embedded. In the zone of the highest temperature, the sheath 5 can be protected in addition by a ceramic coating of silicon carbide or a similar material.

The chamber 7 located between the heat distributor 1 and the tunnel of gases 6 fulfils two objectives. First, it avoids the contact of the combustion gases with the heat distributor 1, by introducing an inert sealing gas in it. Second, this chamber supplies the physical space for the installation of the structural steel, together with its corresponding thermal insulation, that holds up the heat distributor 1. The cover 8 of the FIGS. 1 and 2 corresponds to the thermal insulation that avoids the leakage of heat. In order to protect the heat distributor 1 against corrosion it is convenient to cover it with a coating or a foil of stainless steel. The ash deposited in the lower part of the tunnel 6 is removed by means of the conveyor 9, which run along the tunnel 6 in the same direction as the combustion gas.

Figure 2:
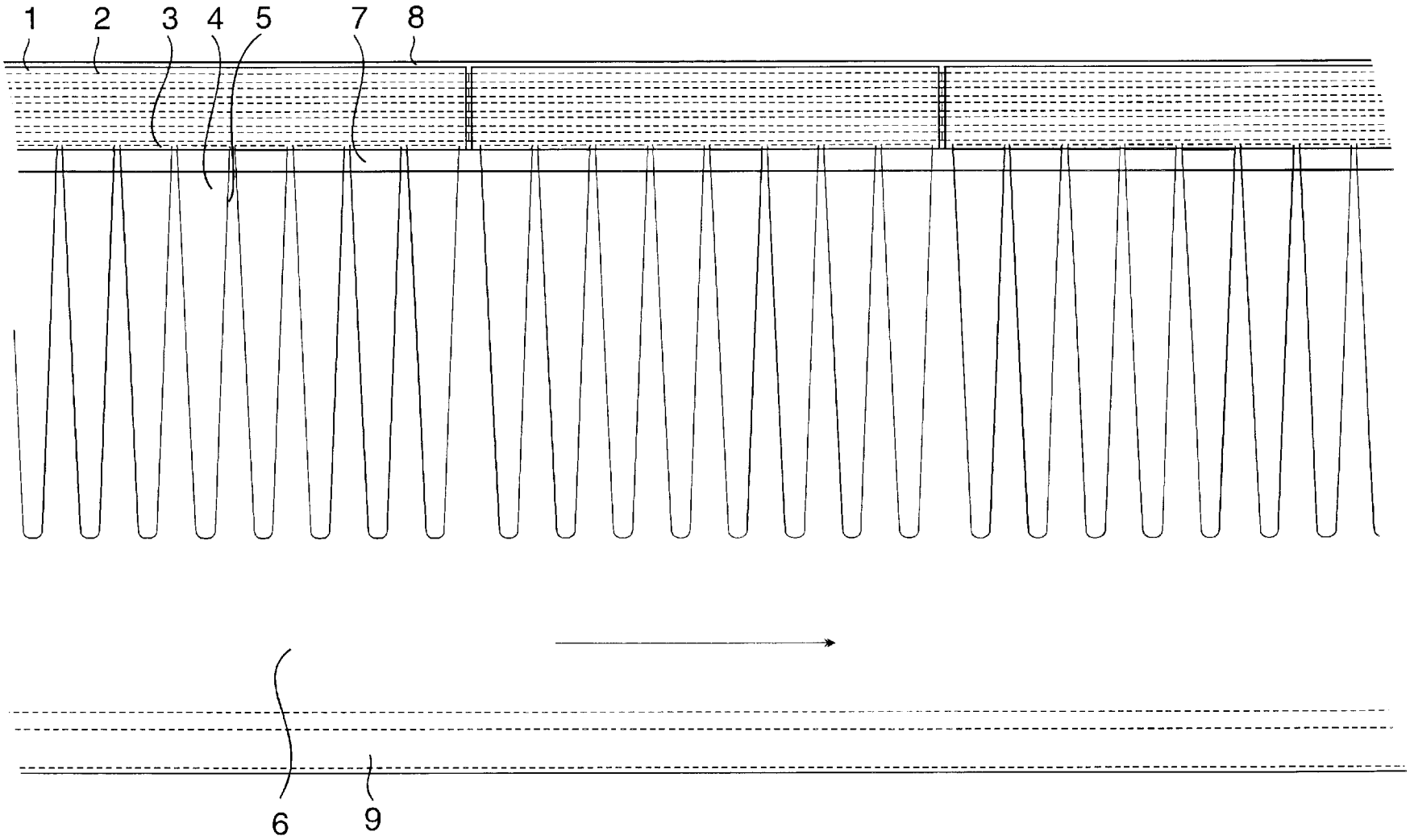

In the FIGS. 1 and 2 the water-tubes 2 have been installed in line along the horizontal as well vertical directions; but they can be installed also in a staggered manner. Besides, the number of tubes in the horizontal direction may decrease according as the distance of the rows to the lower surface of the heat distributor increases. The power of the present steam generator increases mainly by increasing the wide of the heat distributor 1. A steam generator of great capacity may require the existence of several vertical walls along the tunnel 6, in order to support the weight of the heat distributor 1.

For reasons of fabrication, transportation and installation, the heat distributor 1 is made up by a large number of identical pieces, each of them named here the fundamental block. Like the heat distributor, the fundamental block has the geometrical shape of an oblong parallelepiped with rectangular faces. The heat distributor 1 consists then of an arrangement of fundamental blocks in a rectangular platform, with the longer side of the fundamental blocks parallel to the water-tubes 2.

The length, shape and spacing of the heat transfer bars 4, as well the wide of the tunnel 6, can change along the tunnel. The beginning of the tunnel of gases 6 works mainly as a radiation chamber; and in this place the heat transfer bars are shorter and more spaced than downstream. In some places it is convenient to suppress the heat transfer bars 4, as happens in the places where the fundamental blocks rest over the structural steel that holds them up. Also, in order to improve the removal of the ash carried by the combustion gases, it may be convenient to sacrifice the aerodynamic profile of the heat transfer bars in some places of the tunnel 6. For example, if the cutting edge of the upstream side of the heat transfer bar is changed by a groove, then an important fraction of the ash will be directed towards the conveyor 9 of the FIGS. 1 and 2. Besides, the removal of ash is improved when the heat transfer bars are arranged in staggered form instead of in line along the tunnel of gas 6.

The invention showed in the FIGS. 1 and 2 is applicable to the different components of a steam generator as: the economizer, the boiler, the superheater and the reheater. The use of the invention as a condenser is also attractive. In this case the steam is made to flow inside of the water-tubes 2; whereas the air for the combustion is made to flow in the tunnel of gases 6. Thus, in this application the invention works simultaneously as a condenser and as a heater of the air for the combustion.

The lateral and divisional walls of the tunnel 6 of the FIG. 1 can be water-cooled as usual. However, according to this invention it is more suitable to cool down the walls by means of water-tubes embedded, along the tunnel in horizontal position, in a vertical slab of metal or material of high thermal conductivity protected with a corrosive resistant foil.

The use of straight tubes, together with the fact that the outer surface of the water-tubes is not in contact with the corrosive combustion gas, allows to replace the traditional tubes with poor thermal conductivity by composite-tubes of high thermal conductivity. Moreover, the tubes can be manufactured with a thermal conductivity that increases gradually with the radius, in such a way that the outer surface of the tube has the same coefficient of thermal expansion than the material of the heat distributor 1 of the FIG. 1. The water-tubes of the present invention are constructed starting from a base-tube of steel, stainless steel, or a material of high strength, which is resistant to the corrosion and has a relatively thin wall. This thin-walled tube is the inner part, in contact with the water and steam, of the tube of high thermal conductivity. The base-tube plays three fundamental functions. In first place, it resists the corrosive effects of the water and steam and where its poor thermal conductivity is not too important because of its thin wall. In second place, the base-tube allows to manufacture or to fix, in each end of the tube, a cylindrical piece, made with a high strength alloy. These pieces make possible to join the tubes along the heat distributor 1 of the FIG. 2 by bolting, welding or riveting. In third place, the base-tube along with the two cylindrical pieces allows to fix the pre-form of continuous wire of tungsten, silicon carbide fibre, carbon fibre or similar, which is later infiltrated with copper or a material of high thermal conductivity as the one of the heat distributor 1 of the FIGS. 1 and 2.

The pre-form comprises two families of tubular structures of tungsten wire or synthetic fibre. The first family is manufactured with continuous, unidirectional fibres parallel to the axis of the base-tube. This family is the main support for bearing the axial tensile stress present in the tubes because of the high pressure of the water and the steam. The second family consists of tubular structures where the tungsten wire or fibre is coiled around the base-tube. This family is the main support for bearing the radial tensile stress in the tubes. Both families of tubular structures are fixed on the cylindrical pieces that exist at the end of each base-tube. The different tubular structures of both families have, of course, different radii. The tubular structures of unidirectional wire are fixed directly over the cylindrical pieces at the end of the base-tube. For this purpose each cylindrical pieces at the extreme of the tube has a profile that resembles several disks of different radius juxtaposed, such that the radius of each disk decreases as the distance to the corresponding end of the base-tube increases. On the other hand, each tubular structure of the second family is coiled around a thin wall tube, made with a high strength alloy, which has a large number of holes over the whole surface, so as to provide continuous paths for the conduction of the heat through the material of high thermal conductivity down to the base-tube.

The pre-form can be infiltrated in a sequence of steps, or at once; and the thermal conductivity of the tube can be increased with the radius, by increasing the volume fraction of the material of high thermal conductivity with the radius. Due that the outer layer of the tube is of the same material as that of the heat distributor 1 of the FIGS. 1 and 2, the fundamental block can be casted directly over the arrangement of tubes. In this way the fundamental block together with the corresponding set of tubes conforms a monolithic piece.

In order to avoid excessive stress by tensile forces over the protective sheath 5 of the FIGS. 1 and 2, the heat transfer bar 4 may have superficial grooves or internal cavities filled with an inert gas at pressure.

By introducing some rather obvious geometrical changes, the steam generator of this invention can be used in nuclear plants. For this end it is convenient to change the rectangular geometry of the fundamental blocks by a cylindrical one, and to consider two family of tubes. The first is used for the primary circuit, while the second is used for the generation of steam.

What I claim as my invention is:

1. A water-tube steam generator for fossil fuel comprising:

a heat distributor that consists of a great number of fundamental blocks with the shape of an oblong parallelepiped of rectangular faces, made with a material of high thermal conductivity where the water-tubes of high thermal conductivity are lengthwise embedded, and where the fundamental blocks are arranged in a rectangular platform with a length, in the direction parallel to the water-tubes, much larger than its wide;

a large number of heat transfer bars made with a material of high thermal conductivity that hang in vertical position and whose upper end is embedded into the lower surface of the fundamental blocks, and where the heat transfer bar has an oval-shaped cross section when it is cut by a plane parallel to the platform, with its mayor axis, which is parallel to the water-tubes, much larger than its minor axis and such that the length of both axes decrease as the distance to the corresponding fundamental block increases;

a horizontal tunnel of gases of large length, located beneath and all along the heat distributor, where the combustion gas is made to flow;

a rectangular chamber, filled with an inert sealing gas, located all along the wide and the length of the tunel of gases, between the top of the tunnel of gases and the heat distributor.

2. The steam generator of claim 1 wherein: the water-tubes of high thermal conductivity consist of a base-tube of thin wall, made with a strong, stiff and resistant to corrosion material, where in each end there is a cylindrical piece with a sequence of decreasing radius according as the distance to the corresponding end of the base-tube increases, that allows to fix the tubular reinforcement of continuous wire of tungsten or synthetic fibre, formed by a tubular family of unidirectional wire, parallel to the axis of the base-tube, and a tubular family that is coiled around the base-tube, and where the reinforcement is infiltrated with a metal or material of high thermal conductivity, in such a way that the coefficient of thermal expansion and the thermal conductivity increase gradually with the radius up to the values of the fundamental blocks.

* * * * *